United States Patent [19]

Bergstein

[11] 4,099,665

[45] Jul. 11, 1978

[54] RECLOSABLE CARTON WITH TAPERED TOP CLOSURE

[75] Inventor: Robert M. Bergstein, Cincinnati, Ohio

[73] Assignee: The Bergstein Packaging Trust, Middletown, Ohio

[21] Appl. No.: 770,640

[22] Filed: Feb. 22, 1977

[51] Int. Cl.[2] ..... B65D 5/56

[52] U.S. Cl. ..... 220/403; 220/417; 229/17 G; 229/56

[58] Field of Search ..... 229/14 B, 14 BA, 14 BW, 229/14 BE, 51 TC, 17 G, 56

[56] References Cited

U.S. PATENT DOCUMENTS

| | | | |
|---|---|---|---|
| 2,220,746 | 11/1940 | Wentz | 229/17 G |
| 2,292,653 | 8/1942 | Palmer | 229/14 BE |
| 2,345,486 | 3/1944 | Leebov | 229/17 G UX |
| 2,493,337 | 1/1950 | Buttery | 229/14 BW |
| 2,695,745 | 11/1954 | Dixon | 229/17 G |
| 3,308,996 | 3/1967 | Beck | 229/14 BW X |
| 3,322,265 | 5/1967 | Collura | 229/14 B X |
| 3,456,861 | 7/1969 | Wettlen | 229/14 B X |
| 3,478,953 | 11/1969 | Forrer et al. | 229/51 TC |
| 3,949,931 | 4/1976 | Hall | 229/36 |

*Primary Examiner*—Davis T. Moorhead
*Attorney, Agent, or Firm*—Melville, Strasser, Foster & Hoffman

[57] ABSTRACT

A reclosable carton having opposing side and end walls, the upper portions of the end walls being displaceable inwardly so that the uppermost edges of the side walls may be juxtaposed to form a tapered top closure, a closure flap being hingedly connected to the uppermost edge of one of the side walls, the closure flap being foldable over the uppermost edge of the opposite side wall and releasably secured in the folded over condition to form a tight reclosure. When provided with a liner, the upper end of the liner extends above the uppermost edges of the side walls, and is pinched therebetween when the edges of the side walls are juxtaposed, the folding over of the closure flap serving to automatically enforce the folding of the liner mouth over the uppermost edge of the opposite side wall, thereby providing a tight reclosure for the liner as an incident of reclosing the carton. Upon opening of the top closure, the upper portion of either end wall may be displaced outwardly to form a pouring spout for the contents of the carton.

3 Claims, 15 Drawing Figures

RECLOSABLE CARTON WITH TAPERED TOP CLOSURE

BACKGROUND OF THE INVENTION

Numerous forms of sealed cartons have hitherto been provided which effectively protect the contents of the carton until the carton is initially opened. However, once the carton has been opened, it is extremely difficult to provide a tight reclosure for the carton which will insure that the unused portion of the contents will remain protected for use at a later time.

Some of the expedients which have hitherto been employed have included the perforation of the end closure flaps and adjoining areas of the body walls to form reclosable covers. Various forms of reclosable dispensing openings have also been proposed, utilizing plugs and other forms of closures for the dispensing opening. Another approach has been to use pouring spout constructions which assist in the dispensing of the contents as well as provide a closure for the dispensing opening. Generally speaking, such expedients do not provide an effective reclosure which affords adequate protection for the remaining contents.

Where a relatively high degree of protection is required, as where the unused portion of the contents must be protected from the atmosphere, either because the contents are moist and must be prevented from drying out or where the contents are essentially dry but are susceptable to absorption of moisture from the atmosphere, it is customary to provide a liner which will provide the desired degree of moisture-vapor proofness. Where a liner is utilized, it is of course necessary to open the liner, which often results in its mutilation; but even if the liner can be opened without destroying its integrity, carelessness in subsequent folding of the liner often results in an inadequate reclosure. Consequently, even though the packager may take adequate steps to initially protect the contents, the effectiveness of such protection is lost once the carton has been opened.

The present invention seeks to overcome the deficiencies inherent in currently available sealed cartons by providing a carton structure which may be used with or without a liner, the carton having a tapered top closure which may be readily opened to initially dispense the contents and readily reclose to effect a tight reclosure which affords maximum protection for the remainder of the contents.

SUMMARY OF THE INVENTION

In accordance with the invention, the carton has enclosing side and end walls, and is provided with a conventional bottom closure, such as a series of seal-end closure flaps which may be readily folded and glued utilizing conventional carton folding and gluing equipment. The upper portions of the carton end walls are, however, scored to provide bellows-like gussets which, when deflected inwardly, permit the upper portions of the carton side walls to be displaced inwardly, thereby forming a tapered top closure in which the uppermost edges of the side walls are juxtaposed with the uppermost edges of the bellows folded portions of the end walls entrapped therebetween. A closure flap is hingedly connected to the uppermost edge of one of the side walls, the closure flap being foldable over the uppermost edge of the opposite side wall, the closure flap being provided with a locking tongue engageable in a slot in the opposite side wall, thereby securing the closure flap in the folded over condition in which it serves to maintain the juxtaposed upper edges of the opposing side walls in engagement with each other, thereby providing a tight reclosure. If desired, the closure flap may be initially secured in the folded over condition by spots of adhesive which may be broken away to open the carton or the folded over flap may be provided with a tear tab; the locking tongue and slot being utilized only for subsequent reclosure. Once opened the bellows-like gussets at one end of the carton may be displaced outwardly to form a pouring spout to assist in dispensing the contents of the carton.

Where a liner is to be employed, it preferably will be in the form of a flat-folded tube which will be deposited on the flat carton blank and enclosed within the carton as an incident of the tubing of the carton blank to form a flat-folded carton structure. The opposite ends of the liner extend beyond the ends of the carton body so that the ends of the liner may be sealed as an incident of the closing and sealing of the carton. The liner will be automatically erected or "squared" as an incident of the erection of the carton body to rectangular condition, and in an exemplary procedure, the carton body will be erected and advanced with its bottom end closure uppermost, whereupon the extending bottom end of the liner will be flattened and its opposite sides sealed together, followed by the concurrent infolding of the sealed liner end and the bottom closure flaps, which are sealed together to complete the bottom closure. Thereafter, the carton is inverted, filled with contents through its open uppermost end, followed by the sealing of the remaining end of the liner and the formation of the top closure.

The carton of the present invention facilitates the closing and sealing of the upper end of the liner in that the inward deflection of the bellows-like gussets on the carton end walls act to automatically infold the corresponding portions of the liner mouth, and as the carton side walls are moved toward each other the opposite sides of the liner mouth are concurrently juxtaposed, thereby positioning them for contact by a heat sealer which will seal the liner mouth. Thereafter, as the closure flap is infolded, the extending sealed end of the liner also will be infolded over the uppermost edge of the opposite carton side wall, the sealed mouth of the liner being entrapped between the closure flap and the underlying side wall. When it desired to initially open the carton, the seal closing the mouth of the liner may either be broken open or, preferably, the seal will extend along the outermost marginal edge of the liner mouth so that the liner may be severed immediately beneath the seal and still leave an extending portion capable of being folded over the upper edge of the opposite side wall as the closure flap is infolded to reclose the carton. Thus, the upper edge of the side wall opposite the closure flap forms a folding edge for the liner, the reverse folding of the liner mouth over this edge forming a tight reclosure for the liner which is maintained in the folded over condition by the overlying closure flap. Thus, the reclosure of the liner is essentially automatic and occurs as an incident of the reclosure of the carton itself.

Carton structures in accordance with the present invention readily lend themselves to high speed folding and gluing operations, not only in the initial assembly of the cartons and liners into flat-folded tubular structures, but also in their erection, filling and sealing.

Carton structures in accordance with the invention also may be utilized to package multiple increments of contents. Instead of a single tubular liner, divided liners may be employed which provide two or more compartments capable of being individually opened. Where, for example, the liner is divided into dual compartments, the closure flap may also be divided so that only one-half of the closure flap need be initially opened, the closure flap being provided with a medial line for severance which permits opening of only one side of the top closure. Where the carton is to be used in unlined condition, provision can be made to prevent exposure of the contents through the slot in the side wall which is engaged by the locking tongue of the closure flap, the carton being provided with an integral barrier adapted to underlie and seal the area surrounding the slot.

DESCRIPTION OF THE PREFERRED EMBODIMENTS

Figure 1:
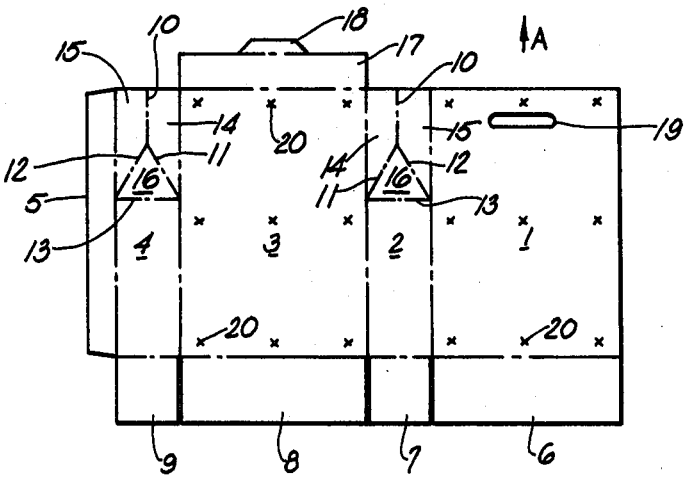
FIG. 1 is a plan view of a carton blank in accordance with the invention.

Referring first to FIG. 1 of the drawings, the carton blank comprises a sheet of suitable paperboard or boxboard cut and scored to provide a side wall 1, and end wall 2, a side wall 3 and an end wall 4 in articulation in the order named, with an attachment flap 5 hingedly connected to the outermost side edge of end wall 4. The body walls 1 through 4 have conventional end closure flaps 6, 7, 8 and 9 at their respective lowermost ends, the bottom end closure flaps being of conventional construction.

In accordance with the invention, the opposing end walls 2 and 4 are scored or cut-scored to provide vertically disposed lines of fold 10 which terminate in angularly disposed lines of fold 11 and 12 which, in turn, terminate at the opposite side edges of the end walls, the lowermost extremities of the diagonal lines of fold being interconnected by horizontally disposed lines of fold 13, the lines of fold collectively defining bellows-like gussets 14, 15 and 16. While the lengths of the gussets may vary relative to the lengths of the opposing end walls 2 and 4, they preferably will lie within the upper half of the carton body walls so that a major portion of the carton will be rectangular in cross-section when erected.

A closure flap 17 is hingedly connected to the uppermost end edge of side wall 3, the closure flap preferably extending the full width of the upper side edge of the underlying side wall 3 and having a locking tongue 18 projecting outwardly from its outermost side edge. A slot 19 is formed in side wall 1, the slot being of a length and positioned to receive the locking tongue 18 when the closure flap 17 is in its closed position.

Figure 2:
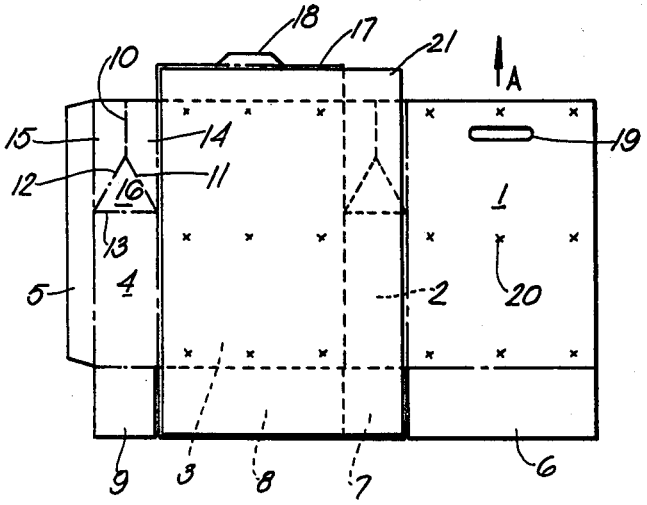
FIG. 2 is a plan view similar to FIG. 1 illustrating the positioning of a flat-folded tubular liner on the carton blank.
Figure 3:
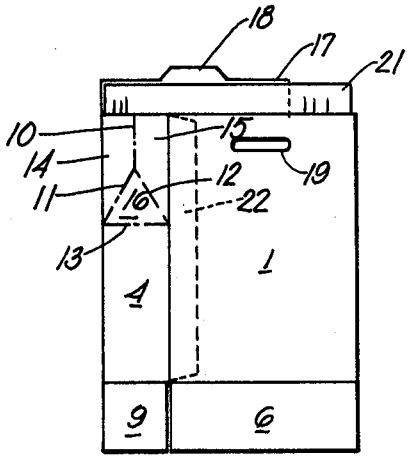
FIG. 3 is a plan view illustrating the blank in flat-folded tubular condition.

With the blank in the condition illustrated in FIG. 1, it may be readily fabricated into knocked-down tubular condition by advancing it in the direction of the Arrow A seen in FIG. 1. If the carton is to be lined, dots or stripes of adhesive may be applied to the upper or inner surfaces of side walls 1 and 3, as indicated by the adhesive spots 20, whereupon a flat-folded tubular liner 21 may be deposited on the advancing blank in the manner illustrated in FIG. 2 using known carton lining equipment; thereafter end wall 4 and attachment flap 5 will be infolded to overlie the adjoining side of the liner, followed by the infolding of side wall 1 lying on the opposite side of the blank, thereby bringing the blank to the flat-folded condition illustrated in FIG. 3, it being understood that a stripe of adhesive will be interposed between the outermost side edge of side wall 1 and the surface of attachment flap 5 contacted thereby, such adhesive stripe being indicated at 22 in FIG. 3. The flat-folded carton blanks may be shipped and stored in the condition illustrated in FIG. 3.

Figure 4:
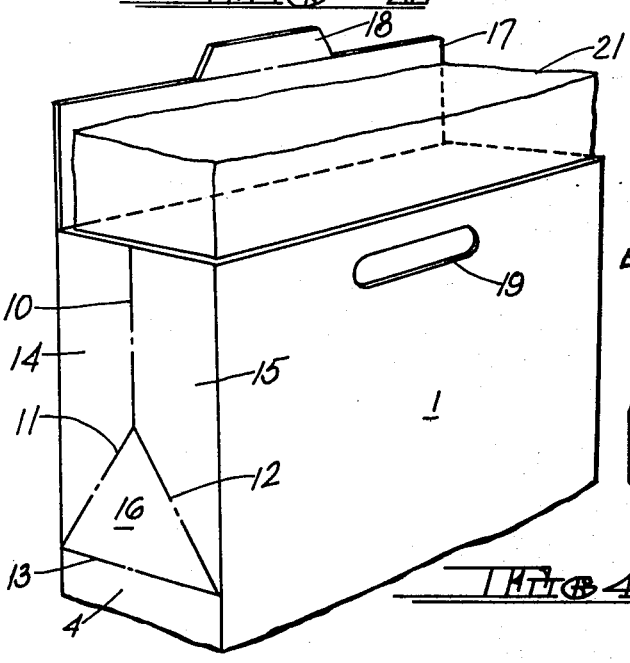
FIG. 4 is an enlarged fragmentary perspective view illustrating the carton and liner in the initially erected condition.

In the hands of the packager, the carton blanks can be readily erected by simply "squaring-up" the carton body walls, the carton walls being moved to positions in which the adjacent walls lie at right angles to each other, such movement serving to automatically erect the tubular liner. Normally, the bottom end of the carton will be sealed first, the carton being inverted and the bottom end of the liner flattened and sealed in conventional fashion, followed by the infolding of the liner and the concurrent infolding and sealing together of bottom closure flaps 6 through 9, as will be readily understood by the worker in the art. Various types of folding and gluing apparatus are available to perform the necessary liner sealing and flap-folding and gluing operations. Following formation of the bottom end closures, the cartons will be inverted and filled with their contents, whereupon the uprighted cartons, in the condition illustrated in FIG. 4, will be advanced for the formation of the top closure.

Figure 5:
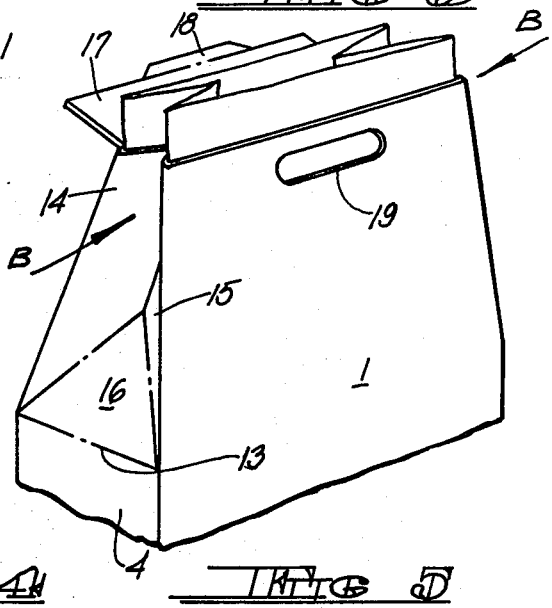
FIG. 5 is a fragmentary perspective view similar to FIG. 4 illustrating the inward deflection of the bellows-like gussets in the end walls and the concurrent folding of the liner mouth.
Figure 6:
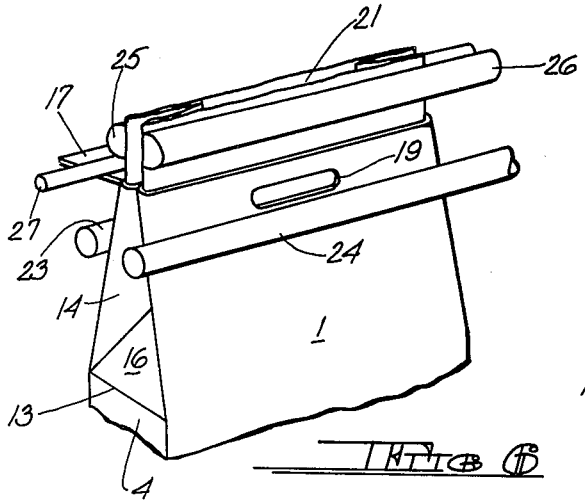
FIG. 6 is a fragmentary perspective view similar to FIG. 5 illustrating the heat sealing of the liner mouth.
Figure 8:
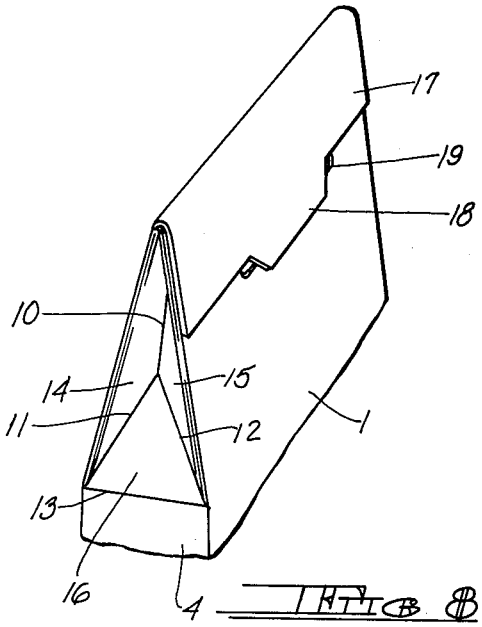
FIG. 8 is a fragmentary perspective view similar to FIG. 7 illustrating the fully assembled carton with the closure flap in closed and sealed position.

In accordance with the invention, the closing of the top closure is initiated by deflecting the sets of bellows-like gussets 14, 15 and 16 inwardly in the manner illustrated in FIG. 5, the inward deflection of the gussets being indicated by the opposing Arrows B in FIG. 5. The inward deflection of the bellows-like gussets may be readily accomplished by coacting sets of folding fingers, such as those disclosed in commonly owned application Ser. No. 716,551, filed Aug. 23, 1976, and entitled "Carton Closing And Sealing Apparatus", the folding fingers contacting the carton end walls in the areas of the vertical lines of fold 10, which causes the gusset members 14 and 15 to fold relative to each other as well as relative to the remaining triangular gussets 16, such folding movement also causes the corresponding portions of the liner to be folded inwardly to form a bellows or pleat, as also will be seen in FIG. 5; and concurrently both the opposing side walls 1 and 3 and the corresponding portions of the liner move inwardly toward each other, the upper portion of the carton side walls assuming the tapered configuration illustrated. It will be understood that once the bellows-like gussets have been deflected inwardly, suitable guide or sweep means may be employed to urge the side walls toward each other so as to juxtapose their uppermost edges and effectively entrap the flattened mouth of the liner therebetween. Exemplary sweep means for such purpose are indicated at 23 and 24 in FIG. 6, together with exemplary heat sealing means 25 and 26 for sealing together the mouth of liner 21. In order to facilitate the engagement of the liner mouth by the heat sealing means 25 and 26, an additional sweep 27 may be utilized to outfold the closure flap 17 in the manner illustrated in FIG. 6, the outfolding of the closure flap also serving to position its inner (uppermost) surface for the application of dots or a stripe of adhesive, indicated at 28 in FIG. 6, by means of which the closure flap is secured to side wall 1 upon subsequent infolding of the closure flap to contact side wall 1 in the manner illustrated in FIG. 8, which shows the end closure in its fully assembled position. As initially closed, the locking tongue 18 will simply overlie the slot 19 but will not be engaged in the slot, such engagement taking place only after the end closure flap has been initially opened by peeling it away from underlying side wall 1.

Figure 7:
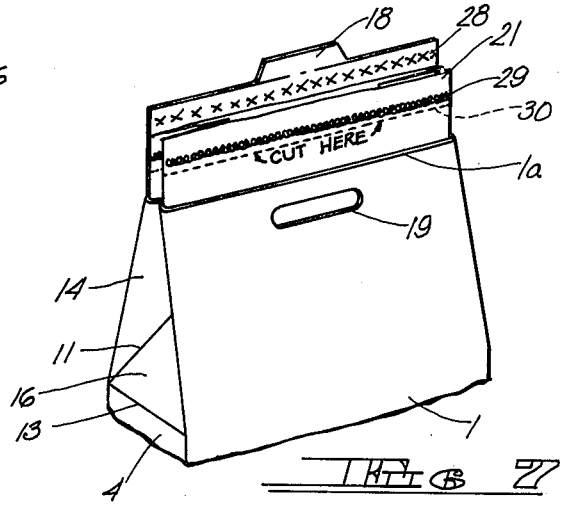
FIG. 7 is a fragmentary perspective view similar to FIG. 6 illustrating the sealed liner just prior to the infolding of the closure flap.

As should be apparent from FIG. 7, when closure flap 17 is infolded, it will automatically infold the extending mouth of the liner, the folding of the liner, as well as the closure flap itself, being enforced by the uppermost edge 1*a* of side wall 1. Such enforced folding of the liner is particularly useful during reclosure since the mouth of the liner will be folded over and hence effectively resealed. In this connection, and as also shown in FIG. 7, it is preferred that the line of seal 29 for the liner mouth be located at or adjacent the uppermost edge of the liner mouth so that a substantial portion of the liner mouth lies between the line of seal 29 and the uppermost edge 1*a* of side wall 1. With this arrangement, a line for severance 30 may be indicated immediately beneath the line of seal 29 so that the user, to initially open the liner, may either cut or otherwise sever the liner along the line 30 and still have an ample portion of the liner mouth available to be folded over the edge 1*a* when the carton is reclosed.

Figure 9:
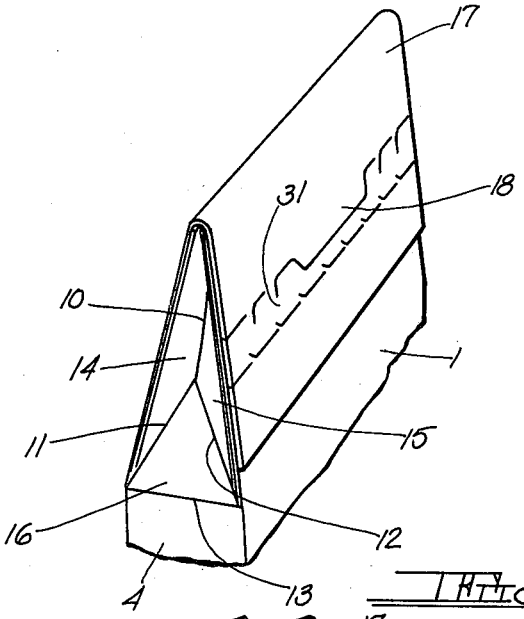
FIG. 9 is a fragmentary perspective view similar to FIG. 8 illustrating a modification of the invention wherein the closure flap incorporates a tear tab.

FIG. 9 illustrates a modification of the invention wherein the closure flap 17 is somewhat elongated and provided with an integral tear strip 31 which may be torn away to expose the underlying folded over mouth of the liner which, preferably, will terminate within the confines of the tear strip 31. In this modification, the locking tongue 18 is formed in the portion of the closure flap 17 lying above the tear strip, the tongue being exposed when the tear strip is removed. A tongue receiving slot will be formed in side wall 1 in a position to receive the tongue 18 upon reclosure.

Figure 10:
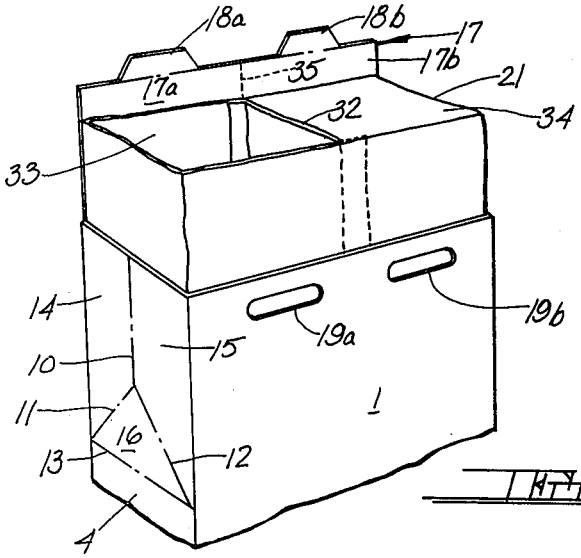
FIG. 10 is a fragmentary perspective view illustrating a modification of the invention wherein the liner is divided into twin compartments and the closure flap is severable into separate flap sections.

FIG. 10 illustrates another modification of the invention wherein the liner 21 is divided by an intermediate flexible wall 32 into a pair of compartments 33 and 34 adapted to receive increments of the same or different contents. Where the liner is divided into multiple compartments, it is preferred to correspondingly divide the closure flap 17 by a line for severance 35 to provide separable flap parts 17*a* and 17*b* each of which is provided with its own locking tongue, such locking tongues being indicated at 18*a* and 18*b;* similarly, the side wall 1 is provided with a mating pair of tongue receiving slots 19*a* and 19*b*.

Figure 11:
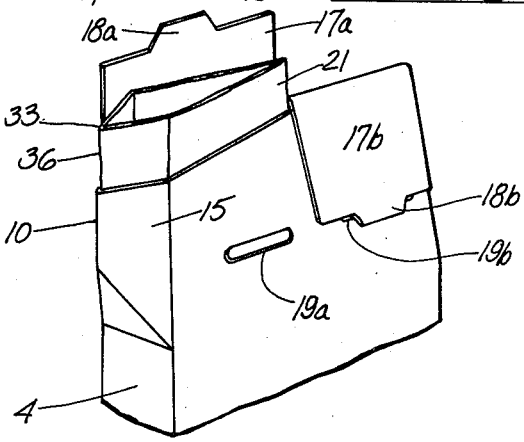
FIG. 11 is a fragmentary view similar to FIG. 10 illustrating the modification of FIG. 10 in partially opened condition with the gussets forming a pouring spout.

The carton structure of FIG. 10 can be closed in the same manner as the constructions previously described, but when it is desired to open the carton, only one of the flaps such as flap 17*a* need be raised to expose the underlying portion of the liner which then may be severed to open the mouth of the underlying compartments 33, as seen in FIG. 11. In order to facilitate the dispensing of the contents from compartment 33 while the flap portion 17*b* and underlying compartment 34 remain closed, it is preferred to displace the bellows-like gussets 14, 15 and 16 in end wall 4 outwardly relative to the opposing side walls 1 and 3, the gussets when deflected outwardly effectively forming a pouring spout for dispensing the contents, as also will be apparent from FIG. 11. It will be understood, of course, that such outward deflection of the bellows-like gussets to form a pouring spout is not limited to the embodiment illustrated in FIGS. 10 and 11, but rather is applicable to all embodiments of the invention, whether lined or unlined. Where the carton is lined, the user, in deflecting the gussets outwardly may readily crease the liner in prolongation of the vertical line of fold 10, thereby forming a peak 36 in the liner (seen in FIG. 11) which further enhances the pouring spout effect.

Figure 12:
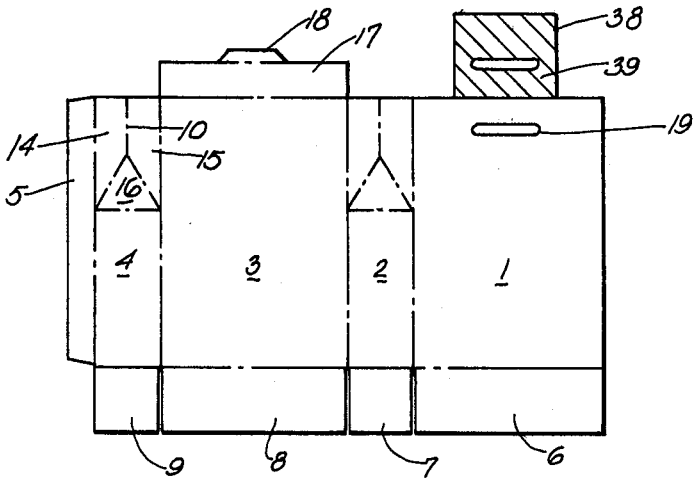
FIG. 12 is a plan view of a blank for forming the modification of the invention wherein a protective panel is provided for the tongue receiving slot in the carton side wall.
Figure 13:
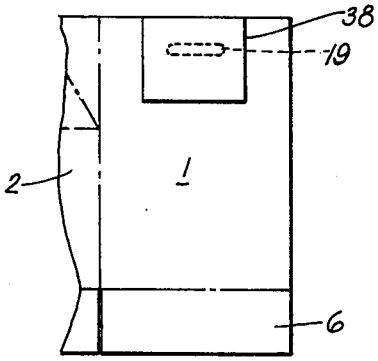
FIG. 13 is a fragmentary plan view illustrating the initial infolding of the slot protecting panel.
Figure 15:
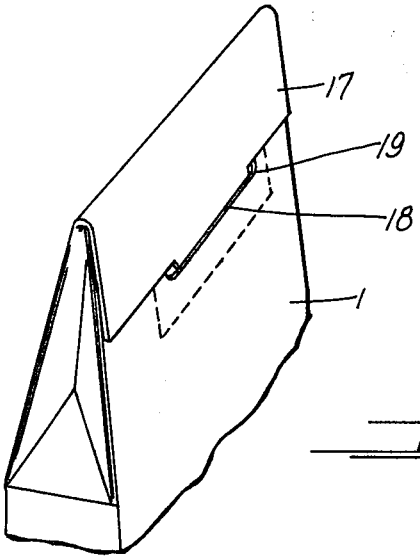
FIG. 15 is a fragmentary perspective view similar to FIG. 14 illustrating the top closure of FIG. 14 in the fully closed position.

FIG. 12 illustrates a further modification of the invention particularly suited for use where the carton is to be used in unlined condition. While the blank is essentially the same as that illustrated in FIG. 1 and like parts have been identified by like reference numerals, the blank is provided with an additional flap member 38 hingedly connected to the uppermost edge of side wall 1, the flap member being of a size to overlie and cover the tongue receiving slot in body wall 1 when infolded to the position illustrated in FIG. 13. Prior to the infolding of flap 38, a band of adhesive 39 will be applied to the flap 38, or alternatively to corresponding portions of side wall 1 in an area surrounding the slot 19, so that when the flap is infolded it will be adhesively secured to the underlying portions of side wall 1, but the adhesive will be spaced from at least the lowermost edge of slot 19 by a distance sufficient to permit the insertion of the tongue 18 through the slot 19 when the flap 17 is reclosed, as will be evident from FIG. 15.

Figure 14:
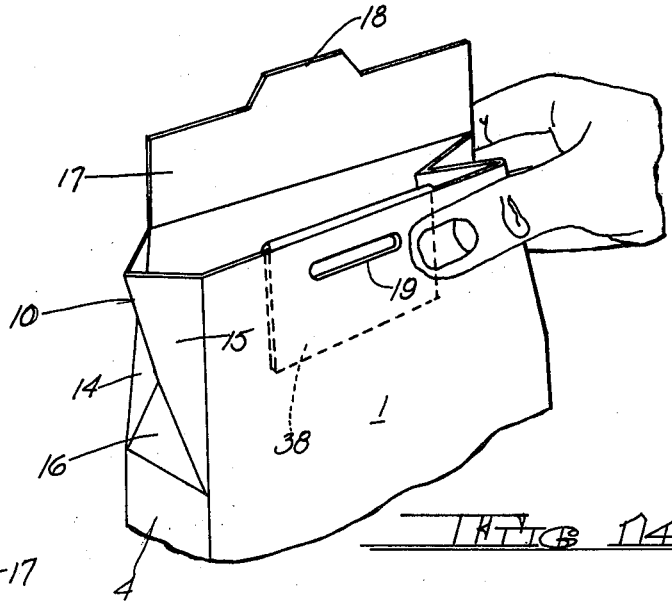
FIG. 14 is an enlarged fragmentary perspective view illustrating the blank of FIG. 13 in the opened condition with the parts displaced to form a pouring spout.

FIG. 14 illustrates the outward deflection of the bellows-like gussets at one end of the opened carton to form a pouring spout to assist in the dispensing of the contents. Where the entire top of the carton has been opened, the effectiveness of the outwardly deflected gussets to form a sharply delineated pouring spout is increased by pressing inwardly on the opposite sides of the carton in the manner illustrated, the inward deflection of the side walls acting to increase the folding action of the gussets relative to each other, thereby increasing the depth of the pouring spout.

As should now be evident, the present invention provides cartons which may be simply and easily opened and closed, the closing of the cartons resulting in a tight reclosure which provides protection for the remaining contents. The degree of protection required will depend upon the nature of the contents being protected. Where a high degree of moisture-vapor proofness is required, it is preferred to utilize a proofing liner which in itself will be chosen to provide the desired proofness. In other instances, the carton itself will provide sufficient proofness, particularly if the carton is formed from coated or laminated boxboard having proofing characteristics. In any event, the particular nature of the board from which the cartons are formed and/or the specific character of the lining materials do not constitute limitations on the invention.

Modifications may be made in the invention without departing from its spirit and purpose; and a number of modifications have already been set forth and others will undoubted occur to the worker in the art upon reading this specification. By way of non-limiting example, while the invention has been described in connection with cartons having four body walls, the principles of the invention are equally applicable to the so-called "six wall" cartons wherein the end walls are medially scored throughout their lengths so that, in the flat-folded condition, the opposing side walls are juxtaposed one upon the other. Similarly, the specific nature of the bottom closures does not constitute a limitation on the invention, and diverse closure flap configurations may be utilized at the bottom end of the carton.

The embodiments of the invention in which an exclusive property or privilege is claimed are defined as follows:

1. A prelined reclosable carton formed from a knocked-down tubular carton structure having opposing side and end walls with bottom closure flaps at their lowermost ends, a tubular liner in said carton having its mouth extending upwardly beyond the uppermost ends of said side and end walls, said liner being adhered to the opposing side walls of said carton as an incident of forming the knocked-down carton structure, said carton end walls being scored to define sets of bellows-like gussets extending downwardly from the uppermost edges of said end walls, each of said sets of gussets being defined by a centrally disposed vertical line of fold extending downwardly from the upper edge of the end wall in which it is formed, said vertical line of fold terminating at its bottom end in a pair of diagonally disposed lines of fold extending downwardly and outwardly to the opposite side edges of the end wall, said lines of fold defining an opposing pair of gussets connected to each other along said vertical line of fold, said sets of gussets, upon erection of said carton body walls relative to each other, being displaceable inwardly between said opposing side walls along said centrally disposed vertical lines of fold and said diagonally disposed lines of fold so as to cause the upper portions of the opposing side walls to flex inwardly relative to each other to form a tapered top closure in which the uppermost edges of said side walls are juxtaposed, said centrally disposed lines of fold, upon inward displacement of said gussets, defining folding edges acting to fold inwardly the portions of the liner mouth contacted thereby to form pleats lying between the opposite sides of the liner mouth, the opposite sides of the liner mouth being concurrently flattened by the upper ends of the side walls as they are flexed inwardly and juxtaposed, with the pleats engaged between the opposite sides of the flattened liner mouth, thereby automatically forming a neatly folded liner mouth as an incident of closing said carton, a closure flap hingedly connected to the upper edge of one of said side walls, said closure flap being infoldable over the uppermost edge of the other of said side walls, whereby as the said closure flap is infolded, the flattened and pleated liner mouth also will be folded over the upper edge of said other side wall, and means for releasably maintaining said closure flap in its folded over position, whereby the mouth of the liner is automatically folded and maintained in its folded condition to form a tight closure for the carton.

2. A reclosable carton having opposing side and end walls with bottom closure flaps at their lowermost ends, said end walls being scored to define sets of bellows-like gussets extending downwardly from the uppermost edges of said end walls, said sets of gussets being displaceable inwardly between said opposing side walls so as to permit the upper portions of the opposing side walls to flex inward relative to each other to form a tapered top closure in which the uppermost edges of the side walls are juxtaposed, a closure flap hingedly connected to the uppermost edge of one of said side walls, said closure flap being foldable over the uppermost edge of the other of said side walls to form a tight reclosure for the carton, means for releasably maintaining said closure flap in its folded over position, the said sets of bellows-like gussets being selectively displaceable outwardly upon reopening of the carton to provide a pouring spout for dispensing its contents, and a tubular liner in said carton, the mouth of said liner extending upwardly beyond the uppermost ends of said side and end walls, whereby when said gussets are deflected inwardly the portions of the liner mouth contacted thereby will be folded inwardly to form pleats lying between the opposite sides of the liner mouth and the opposite sides of the liner mouth will be flattened by the upper ends of the side walls as they are concurrently flexed inwardly, whereupon as said closure flap is folded over the uppermost edge of said other side wall, the flattened mouth of the liner will be folded over the upper edge of the other side wall and maintained in the folded condition by the folded over closure flap, said liner being divided lengthwise into a pair of compartments, and said closure flap being divided by a line for severance into a pair of flap parts overlying each of said compartments, whereby said flap parts may be selectively opened to provide access to the underlying compartment.

3. The carton structure claimed in claim 2 including means for separately maintaining each of said flap parts in its folded over position.

* * * * *